US006736691B1

(12) United States Patent
Bach

(10) Patent No.: US 6,736,691 B1
(45) Date of Patent: May 18, 2004

(54) TOY BUILDING SET WITH INTERCONNECTION BY MEANS OF TENONS WITH SNAP

(75) Inventor: Erik Bach, Billund (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/889,369

(22) PCT Filed: Apr. 14, 2000

(86) PCT No.: PCT/DK00/00015

§ 371 (c)(1),
(2), (4) Date: Jul. 13, 2001

(87) PCT Pub. No.: WO00/41792

PCT Pub. Date: Jul. 20, 2000

(30) Foreign Application Priority Data

Jan. 15, 1999 (DK) ..... 1999 00036

(51) Int. Cl.[7] ..... A63H 33/08

(52) U.S. Cl. ..... 446/128; 446/85; 446/116; 446/120; 446/122

(58) Field of Search ..... 446/120, 121, 446/116, 122, 124, 125, 126, 127, 128

(56) References Cited

U.S. PATENT DOCUMENTS

| | | | | |
|---|---|---|---|---|
| 2,885,822 A | | 5/1959 | Onanian | |
| 3,611,609 A | * | 10/1971 | Reijnhard | 446/121 |
| 4,823,532 A | * | 4/1989 | Westerburgen | 446/122 |
| 5,322,466 A | * | 6/1994 | Bolli et al. | 24/453 |
| 5,839,938 A | * | 11/1998 | Manthei et al. | 446/102 |
| 5,964,635 A | * | 10/1999 | Krog | 446/116 |

FOREIGN PATENT DOCUMENTS

| | | |
|---|---|---|
| DE | 1603337 | 5/1970 |
| DE | 3306887 | 8/1984 |
| EP | 0 228 103 | 7/1987 |
| GB | 1238975 | 7/1971 |
| WO | WO 93/08886 | 5/1993 |

* cited by examiner

*Primary Examiner*—Derris H. Banks
*Assistant Examiner*—Dmitry Suhol
(74) *Attorney, Agent, or Firm*—Pitney, Hardin, Kipp & Szuch LLP

(57) ABSTRACT

A toy building set comprising box-shaped building elements that have, in the horizontal plane, dimensions that are integer multiples of a horizontal module (L), and, in the vertical direction, a height (H) which exceeds the horizontal module. The building elements have a tubular opening at a first face. Elements are provided that have a tenon that can be introduced into the tubular opening. At its free end, the tenon is flexible and has protruding edges (23) for snap-effect with the second end of the tubular opening, and the tenon has a protruding portion (21) that serves to ensure that the tenon can be introduced only so deeply into the tubular as corresponds to the horizontal module (L). The building set comprises building elements (30) with coupling studs (31) on the top face and a cavity (32) with a tubular coupling means (33), whereby two such elements are able to interconnect with coupling studs (31) in contact with the sides of the cavity (32) and the tubular member (33). The tube has internal edges (40, 42) whereby a tenon can be introduced into the tubular member with snap-effect with the internal edge in the tube.

1 Claim, 2 Drawing Sheets

TOY BUILDING SET WITH INTERCONNECTION BY MEANS OF TENONS WITH SNAP

The present invention relates to a toy building set with box-shaped building elements having, in a horizontal plane defined by two directions perpendicular to each other, dimensions that are integer multiples of a first module and having, in a third direction perpendicular to this plane, a third dimension, ie the height, which is between one time and twice the first module. At least one of the building elements has a tubular opening in a first lateral face, and elements are provided that have a tenon that can be introduced into the tubular opening by a snap-effect.

Such building sets are known and marketed under the trade mark LEGO TECHNIC that pose great challenges and present many options to the user for building imaginative as well as authentic constructions. The length of the tenons is in accordance with the module of the building elements in the two directions perpendicular to each other, and interconnecting of two or more building elements by means of connecting tenons occurs only in this plane whereby building elements are interconnected side by side.

In these prior art building sets the building elements are also provided with coupling studs on one side whereas the opposite side is hollow and able to receive coupling studs on another building element. However, this possible way of interconnecting building elements is not a prerequisite for the present invention since a building system in which interconnecting occurs by means of tenons is an independent building system.

U.S. Pat. No. 2,885,822 discloses a toy construction set of hollow blocks. The walls have openings giving access to the interior of the blocks. Interconnecting clips have split opposite ends with snap beads for inserting into openings in the walls of two blocks and releasably securing the blocks adjacent each other.

EP 228 103 discloses hollow stackable building elements with coupling studs and an opposed cavity for receiving coupling studs on another element. The coupling studs have an opening for receiving a coupling pin. The coupling pling pin extends through the element and engages the coupling stud on another element.

It is desirable to have a toy building set wherein interconnecting by means of tenons with snap is also an option in the vertical direction, ie that direction where the dimension of the building elements exceeds the module in the two other directions. This is a problem, the tenons being shorter than the height of the building elements. If it was thus desired to provide these prior art building elements with tubular openings in the vertical direction (height) of the elements and with the same configuration as the horizontal openings, the vertical openings would necessarily have such length that the free ends of the tenons would not be able to enter sufficiently deeply into the openings for them to establish a snap engagement.

The present invention eliminates this problem in that the vertically extending tubular openings feature an internal flange at a distance from the ends of the openings corresponding to the first module from the first end of the tubular openings.

Hereby it is also possible to interconnect the building elements in a vertical direction by use of the same tenons as in case of side-by-side interconnecting. Thus, building elements can be interconnected horizontally as well as vertically by means of the same type of connecting bushings with tenons, and interconnecting in the vertical direction can be combined with the known interconnecting by means of studs in purely frictional engagement with the walls of a cavity. Hereby particularly strong interconnecting with increased resistance to separation is accomplished.

The toy building set according to the invention also allows the novel building elements to be interconnected with the known LEGO TECHNIC building elements in a position where they have been pivoted by 90° whereby the coupling studs have a horizontal orientation. Now, it is possible to build horizontally with the known elements with studs in purely frictional engagement with the walls of a cavity.

Finally, two building elements according to the invention can be interconnected with their cavities facing each other and their coupling studs facing in opposite directions.

In the following, the invention will be described with reference to a preferred embodiment and to the drawings, wherein FIG. 1 is a perspective, top plan view of a known toy building element;

Figure 4A:
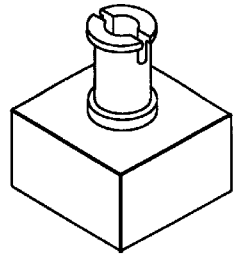
FIG. 4 is a sectional view of the prior art building elements shown in FIG. 3, in their interconnected state.
Figure 4:
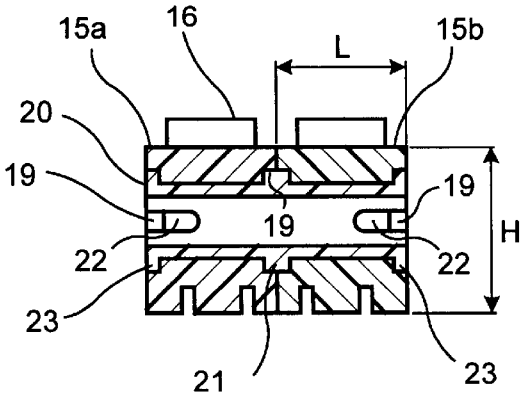
Figure 4B:
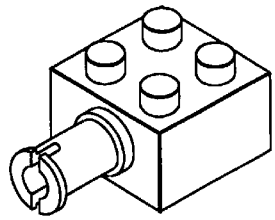
Figure 5:
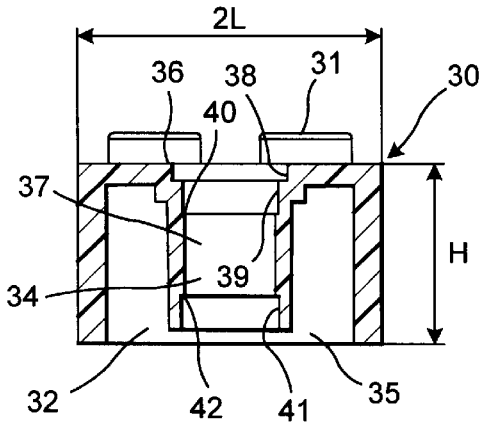
Figure 6:
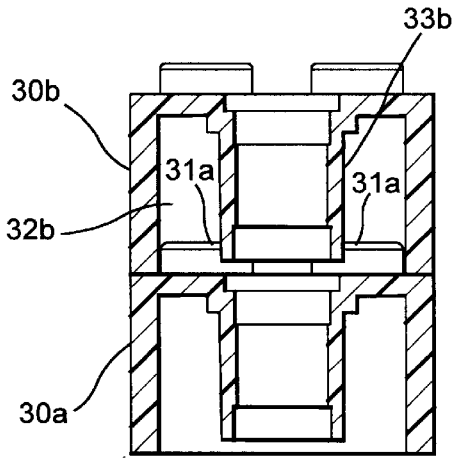
Figure 7:
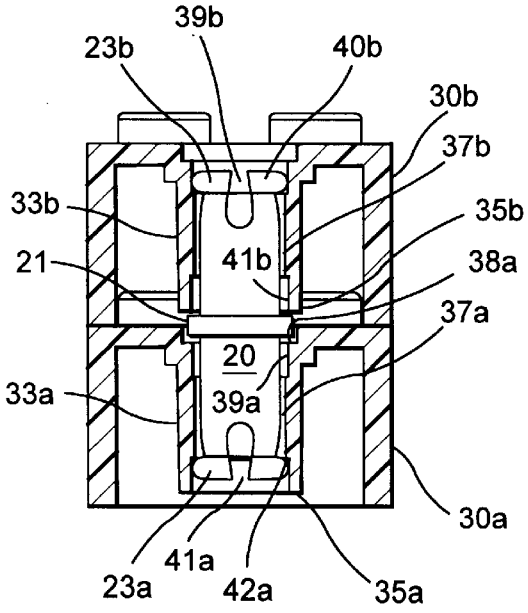
Figure 8:
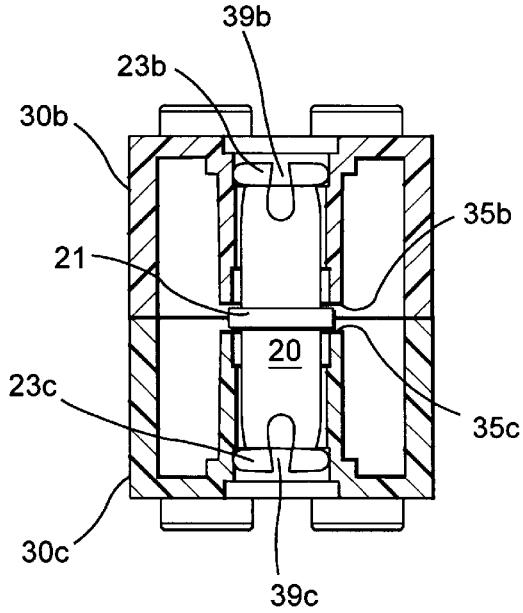

FIGS. 4A and 4B each show a known toy building element;

FIG. 5 is a vertical sectional view of a toy building set according to the invention;

FIG. 6 is a vertical sectional view of two building elements like in FIG. 5, interconnected to be on top of each other;

FIG. 7 is a vertical sectional view of the two building elements shown in FIG. 6 with a connecting tenon; and FIG. 8 is a vertical sectional view of two building elements like in FIG. 5, interconnected in an alternative manner and using a connecting tenon.

Figure 1:
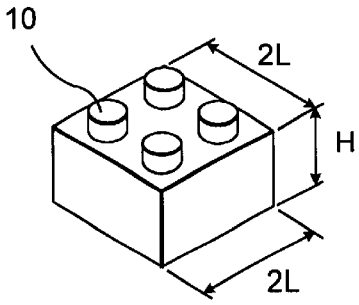
Figure 2:
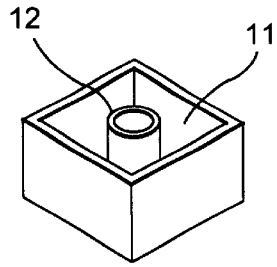
FIG. 2 is a perspective, bottom plan view of the known building element shown in FIG. 1.

FIGS. 1 and 2 illustrate prior art toy building elements having an outer shape like rectangular boxes with square horizontal contour with an edge length 2L and the height H. These building elements have on their top face four cylindrical coupling studs 10 so arranged that the centres of said coupling studs form a square having an edge length L. The elements are, at their bottom end, open with access to a cavity 11 within the elements. These prior art building elements can be interconnected by the two elements being arranged on top of each other so as to cause the coupling studs 10 on one of the elements to enter the cavity 11 within the second element whereby the coupling studs frictionally engage with the lateral walls of the cavity and with a tubular coupling element 12 centrally in said cavity 11. This is described in U.S. Pat. No. 3,005,282.

Figure 3:
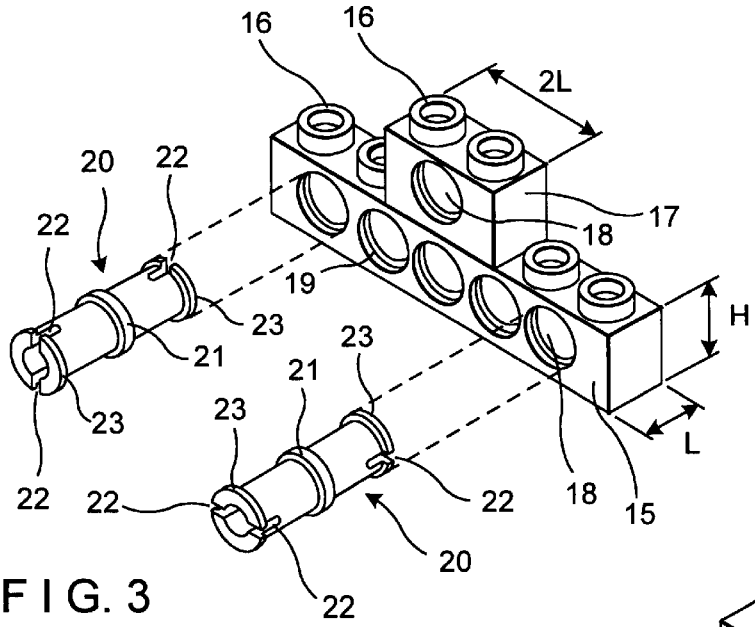
FIG. 3 illustrates prior art building elements in a known toy building set marketed under the trade name LEGO TECHNIC.

FIG. 3 illustrates other known toy building elements. A box-shaped building element 15 with width L and length six times the width L has, on its top face, a row of six tubular coupling studs 16 with the same outer diameter as the coupling studs 10 on the elements shown in FIGS. 1 and 2. A second box-shaped building element 17 has the width L and a length twice the width L and has two tubular coupling studs 16 on its top face. The distance between the centres of the coupling studs on the building elements 15 and 17 is the same as the width, of the building elements, viz L. The building elements 15 and 17 both have a (not shown) cavity at the bottom thereof that is able to receive coupling studs 10 or 16 on another building element. The building element 17 is, in FIG. 3, built on top of the building element 15, and two of the coupling studs 16 on the element 15 have thus been received in the cavity within the element 17.

The prior art building elements 15 and 17 shown in FIG. 3 have one and five, respectively, through-going openings 18 with circular cross-section and extending between two opposite sides. Each of the openings 18 have at both ends, ie at the respective sides of the building elements, a recess 19, which is a short portion where the opening has a slightly increased diameter.

FIG. 3 also shows two prior art connecting bushings 20. The connecting bushings 20 are tubular and at their central portion they have a protruding, annular flange or collar 21, and on the two sides of the flange 21, the connecting bushings have two oppositely oriented tubular tenons. Each of the two tenons of the connecting bushings has, at its free end, two axially extending slots 22 that extend from the ends of the tenon and a distance inwards from said ends. Furthermore, at the end of each tenon two ribs or beads 23 are provided that extend annularly and substantially between the slots 22. The slots 22 enable the ends of the tenons to flex in the radial direction.

As hinted by dotted lines in FIG. 3, the tenons of the connecting bushings can be introduced into the openings 18 whereby the connecting bushings 20 can be used to interconnect two building elements of the shown type. The beads 23 impart to the end of the tenon a thickness, which slightly exceeds the diameter of the through-going openings 18. Introduction of the end of a tenon into an opening 18 will cause the beads 23—that have a rounded profile—to initially touch the recess 19 when it reaches the transition to the tubular portion of the opening 18. Hereby the two parts of the tenon end will be pressed together to allow the tenon to be introduced into the opening 18, and the beads 23 will slide across the inside of the tubular flange portion of the opening 18. The tenon flange 21 will hereby be caused to engage with the recess 19 and prevent the tenon from being conveyed completely through the opening, and the beads 23 will be caused to engage with the recess 19 at the opposite end of the opening 18 which means that the flexing ends of the tenons will expand again with a snap-effect, and here the beads 23 will counteract withdrawal of the tenon.

This has been shown in FIG. 4 wherein two building elements 15*a* and 15*b* are positioned next to each other in such a manner that their openings 18 are aligned and with a connecting bushing 20 in an opening 18 on each of the building elements 15*a* and 15*b*. Now, the flange 21 of the connecting bushing is located in the two recesses 19 that are adjacent, and the beads 23 of the tenon are in located in each of their respective recesses 19 at the free sides of the elements. The two building elements 15*a* and 15*b* are thus interconnected by means of a connecting bushing 20. The interconnected elements can readily be separated by pulling apart whereby the flexing ends of the connecting bushing 20 are compressed, and the beads 23 will slide across the inside of the tubular portion of the opening 18 thereby allowing easy withdrawal of the tenon from the opening by a snap-effect, thus separating the elements.

The known toy building elements in FIGS. 4A and 4B each have a protruding bushing corresponding to one half of the bushing 20 integrated on an outer wall. The protruding bushings are thus inseparable parts of the elements.

FIG. 5 shows a toy building element 30 according to the invention having the same outer dimensions as the known building element shown in FIGS. 1 and 2, viz height H and edge lengths 2L. On its top face the building element 30 has cylindrical coupling studs 31 of the same type as the studs 10 on the elements shown in FIGS. 1 and 2. Like the element shown in FIGS. 1 and 2, the element 30 has a cavity 32 at the bottom and a centrally arranged coupling tube 33 in permanent connection with the upper wall that constitutes the upward delimitation of the cavity. Unlike the known element shown in FIGS. 1 and 2, the coupling tube 33 on the building element 30 has a through-going opening 34, and the coupling tube 33 is thus open at its bottom end 35 as well as at its upper end 36, which is'situated centrally in the square defined by the four coupling studs 31. The coupling tube 33 can receive a tenon or connecting bushing in its interior in a manner corresponding to that of the openings 18 in the building elements shown in FIGS. 3 and 4.

FIG. 6 shows two building elements 30*a* and 30*b* that are identical with the building element 30. The building elements 30*a* and 30*b* are interconnected to be on top of each other in the same known manner in which two building elements like the ones shown in FIGS. 1 and 2 can be interconnected. Herein the four coupling studs 31*a* on the building element 30*a* have been received in the cavity 32*b* in the building element 30*b* in such a manner that the coupling studs 31*a* are in frictional contact with the inner walls that surround the cavity 32*b*, and with the outside of the coupling tube 33*b* as described in U.S. Pat. No. 3,005,282.

FIG. 5 also illustrates how the coupling tube 33 has sections with different diameters. A central section 37 has the smallest diameter corresponding to the diameter of the openings 18 in the prior art building elements shown in FIGS. 3 and 4. At its upper end the coupling tube 33 has a recess 38 with a larger diameter than the central section 37, and thus the recess forms an edge with a face perpendicular to the vertical axis of the tubular member. The recess 38 here corresponds to the recess 19 on the building elements shown in FIGS. 3 and 4.

At a specific distance from the bottom end 35, the coupling tube 33 has a first section 39 with a diameter that exceeds the diameter of the central section 37 and is smaller than the diameter of the recess 38. At the transition between the central section 37 and the first section 39, a first edge 40 is thus provided that forms a face perpendicular to the vertical axis of the tubular member and which faces upwards towards the upper end 36.

Furthermore the coupling tube 33 has, also at a specific distance from the recess 38, at the upper end a second section 41 with a diameter that exceeds the diameter of the central section 37 and corresponding to the diameter of the first section 39. At the transition between the central section 37 and the second section 41, a second edge 42 is thus provided that forms a surface perpendicular to the vertical axis of the tubular member and facing downwards towards the bottom end 35.

Such configuration of the inside of the coupling tube 33 allows same to receive a tenon or the one end of a connecting bushing 20 from the bottom end 35 as well as from the upper end 36. This will appear from FIGS. 7 and 8.

FIG. 7 shows the same toy building elements 30*a* and 30*b* interconnected in the same manner as in FIG. 6, and moreover a connecting bushing 20 has been fitted which has two oppositely oriented tenons in the coaxial coupling tubes 33*a* and 33*b* of the two building elements. The flange 21 of the connecting bushing 20 is situated at the interface between the building elements 30*a* and 30*b* whereby the flange 21 is situated between the recess 38*a* in the building element 30*a* and the bottom end 35*b* of the coupling tube 33*b* of the building element 30*b*. The diameter of the flange 21 exceeds the diameter of the first section 39*a* and exceeds the diameter of the second section 41*b*, which means that the connecting bushing cannot enter deeper into the coupling tubes 33*a* and 33*b* than to the position shown. The connecting bushing has been introduced as described above in connection with FIGS. 3 and 4, the edge 42*a* co-operating with the beads 23*a* of the connecting bushing with a snap-effect, and the edge 40*b* co-operating with the beads 23*b* of the connecting bushing with a snap-effect.

This combination of two building elements 30*a* and 30*b* with a connecting bushing means that the force used to keep the elements together as shown in FIG. 6 is supplemented with the force used by the connecting bushing to keep the elements together. Hereby a particularly strong coupling between the elements is obtained.

FIG. 8 illustrates an additional interconnecting option wherein two toy building elements 30*b* and 30*c* have been interconnected bottom-by-bottom by means of an interconnecting bushing 20. Here, the flange 21 of the connecting bushing is situated between the two bottom ends 35*b* and 35*c* of the coupling tubes of the building elements, and the beads 23*b* and 23*c* of the connecting bushing are located in each of their respective first sections 39*b* and 39*c* of the coupling tubes of the building elements. Here, the building elements 30*b* and 30*c* are kept together exclusively by means of the connecting bushing 20 in a manner that corresponds to the disclosures of FIG. 4, and assembly and separation occur as described above in connection with FIG. 4.

Toy building elements 30 according to the invention are fully compatible with the prior art toy building elements shown in FIGS. 1 through 4 and they can in a known manner be interconnected therewith by means of the coupling studs 10, 16 and 31 in frictional engagement with the cavities 11 and 32 of the building elements and with the coupling tubes 12 and 33 in the cavities.

Toy building elements 30 according to the invention can also be interconnected with the prior art building elements shown in FIGS. 3 and 4 exclusively by means of connecting bushings 20, the one tenon of which has been introduced into coupling tubes 33 from the bottom end 35, and the other tenon of which has been introduced into an opening 18 in a building element 15 or 17.

What is claimed is:

1. A toy building set comprising a first type of box-shaped building elements (15, 17) that have, in a first direction, a first dimension which is a first integer multiple of a first module (L), and have, in a second direction perpendicular to the first direction, a second dimension which is a second integer multiple of the first module (L), and have, in a third direction perpendicular to the first direction perpendicular to the second direction, a third dimension (H) which is larger than the first module (L) and smaller than twice the first module (L), the building elements of the first type having a top wall with an outer face extending in the first and second directions, the top wall having protruding coupling studs (10, 16), the building elements of the first type further having four side walls defining a coupling cavity with an opening of the cavity opposite the top wall for receiving coupling studs on another building element in a releasable engagement, and a connecting element (20) with a pair of opposed tenons, the tenons being, at free ends thereof, flexible and having protruding edges (23), the connecting element having a length corresponding to two times the first module (L), and having, between the opposed tenons, a flange (21) having a larger diameter than the tenons and a length, and at least two of the building elements of the first type having the first integer equal to one and having two opposed outer faces perpendicular to the first direction, and at least one tubular opening (18) extending between the two opposed outer faces, the tubular opening having a diameter smaller than the diameter of the flange, the two opposed outer faces having, at each end of the tubular opening, a recess (19) of larger diameter than the flange (21) and a depth corresponding to half the length of the flange (21), the tubular opening being dimensioned to receive a tenon with the flange seated in the recess on one outer face and the protruding edges on the tenon in snap-fit engagement with the recess on the opposite outer face, characterized in that the building set comprises building elements of the first type, in which the first and second integers are both greater than or equal to two, and the top wall has at least four coupling studs arranged in a square configuration, and a tubular coupling element (33) with a tubular opening (34), the tubular coupling element extending from the top wall into the coupling cavity and being arranged centrally relative to the square, the top wall having an opening into the tubular coupling element and, at the opening into the tubular coupling element, a recess (38) of larger diameter than the flange (21) and a depth corresponding to half the length of the flange, the tubular coupling element having, opposite the top wall, a free end (35) situated at a distance from the opening of the coupling cavity corresponding to half the length of the flange, the tubular opening (34) in the tubular coupling element (33) having a central section (37) of reduced diameter and opposed ends defining first and second edges (40, 42) between the recess (38) and the free end (35), the tubular opening (34) in the tubular coupling element (33) being dimensioned to receive a tenon of a connecting element with the flange (21) seated against the free end (35) of the tubular coupling element (33) and the protruding edges (23) on the tenon in snap-fit engagement with the first edge (40) of the central section (37), and the tubular opening (34) in the tubular coupling element (33) being dimensioned to receive a tenon of a connecting element with the flange (21) seated in the recess (38) on the top wall and the protruding edges (23) on the tenon in snap-fit engagement with the second edge (42) of the central section (37).

* * * * *

UNITED STATES PATENT AND TRADEMARK OFFICE

CERTIFICATE OF CORRECTION

PATENT NO. : 6,736,691 B1
DATED : May 18, 2004
INVENTOR(S) : Erik Bach

It is certified that error appears in the above-identified patent and that said Letters Patent is hereby corrected as shown below:

Title page,
Item [22], PCT filed, delete "Apr. 14, 2000" and insert -- Jan. 14, 2000 --.

Signed and Sealed this

Twenty-first Day of September, 2004

JON W. DUDAS
*Director of the United States Patent and Trademark Office*